313-422 SR
1/19/88 XR 4,720,657

United States Patent [19]
Tischer

[11] Patent Number: 4,720,657
[45] Date of Patent: Jan. 19, 1988

[54] IMPLOSION PROTECTION FOR SHALLOW IMAGE DISPLAY DEVICE HAVING FRONT SCREEN WITH REARWARDLY PROJECTING WALLS

[75] Inventor: Kurt M. Tischer, Wendlingen, Fed. Rep. of Germany

[73] Assignee: Standard Elektrik Lorenz AG, Stuttgart, Fed. Rep. of Germany

[21] Appl. No.: 809,085

[22] Filed: Dec. 13, 1985

[30] Foreign Application Priority Data

Dec. 14, 1984 [DE] Fed. Rep. of Germany ..... 3445628

[51] Int. Cl.[4] ..... H01J 29/82; H01J 29/86
[52] U.S. Cl. ..... 313/497; 313/495; 313/422; 220/2.3 A; 358/246
[58] Field of Search ..... 313/422, 493, 495, 497; 220/2.1 A, 2.3 A; 358/246

[56] References Cited

U.S. PATENT DOCUMENTS 3,171,056 2/1965 Gabor ..... 313/422 X
4,377,766 3/1983 Lenz et al. ..... 313/495 X

*Primary Examiner*—Leo H. Boudreau
*Assistant Examiner*—K. Wieder
*Attorney, Agent, or Firm*—Christie, Parker & Hale

[57] ABSTRACT

A shallow electronic image display device having a trough-shaped display screen of glass with a slightly convex exterior surface and a planar phosphor coated interior surface with a peripheral side wall terminating in an edge defining a common plane in sealing relation with a matingly configured peripheral flange of a tray-shaped metallic back case to form a chamber. Disposed within the chamber within the back case is an areal cathode structure in generally parallel relation with the interior surface of the screen with a plate-shaped electron beam control structure in parallel relation intermediate the interior surface and the areal cathode structure. A tensioned metal band encircles the side walls of the display screen to provide implosion protection.

17 Claims, 1 Drawing Figure

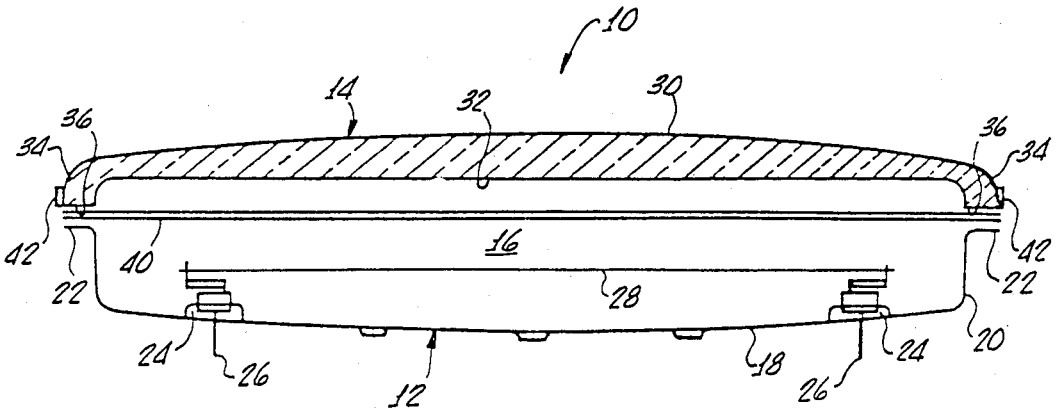
10
14
32
30
36
34
36
34
42
40
16
42
22
28
22
24
26
12
18
26
24
20

IMPLOSION PROTECTION FOR SHALLOW IMAGE DISPLAY DEVICE HAVING FRONT SCREEN WITH REARWARDLY PROJECTING WALLS

CROSS-REFERENCE TO RELATED APPLICATION

This application is related to a commonly assigned patent application filed in the United States under Ser. No. 809,098 and entitled "Flat Image Display Device", by W. Bernhard, M. Schlipf and K. M. Tischer, such application corresponding to published German patent application Ser. No. 34 45 629, the teachings of which are hereby incorporated by reference.

BACKGROUND OF THE INVENTION

The background of the invention will be discussed in two parts:

FIELD OF THE INVENTION

This invention relates to electronic image display devices, and more particularly to a shallow electronic image display device having a trough-shaped display screen with a shallow tray-shaped metallic back case with an areal cathode structure and a plate-shaped electron beam control structure.

DESCRIPTION OF THE PRIOR ART

Since the advent of the cathode ray tube, attempts have been made to eliminate the protruding neck portion in order to provide an electronic image display device of shallower depth. In addition to the electron beam control structures within the device contributing to the undesirable depth, implosion protection has caused part of the problem, due to the use of unduly thick glass front panels or screens as a means of providing such implosion protection.

One such prior art electronic image display device is shown and described in an article entitled "Der flache Fernsehbildschirm", published in the technical journal "Funkschau" 1980, No. 10, pp. 63 to 66. In FIG. 2 of the article there is shown a prior art flat picture electronic imaging display device. This device includes an enclosure formed of a metal back case or envelope with a phosphorcoated front panel of glass which is relatively thick, the interior thereof being evacuated. Within the back case is an areal cathode structure sending a uniform stream of electrons in a direction toward an electron beam control structure, with control being effected by a digitally addressable control structure for forming and modulating the electron stream to produce the image. The metal back case, or envelope, includes an edging flange on which the marginal area of the front glass panel rests. For maintaining a certain mechanical stablity as well as protection against atmospheric influences, the front panel must be relatively thick thus increasing the weight of the conventional type of picture display device. Moreover, with a thick glass layer, distortions, attenuations and aberrations are caused in the produced image.

Accordingly, it is an object of the invention to provide a new and improved electronic image display device.

It is another object of the present invention to provide a new and improved flat image display device.

It is a further object of the present invention to provide a new and improved generally shallow electronic image display device having a trough-shaped front display panel with provision for implosion protection about the periphery thereof.

SUMMARY OF THE INVENTION

The foregoing and other objects of the invention are accomplished by providing an evacuated enclosure formed of a shallow generally tray-shaped metallic back case or envelope having a peripheral flange in abutting sealed relation with the peripheral edge of the sidewalls of a shallow trough-shaped glass front panel or display screen having a phosphor coated generally planar interior surface. An implosion protection metallic band is tensioned about the periphery of the side walls of the front panel. An areal cathode structure is mounted within the tray-shaped back case with a plate-shaped electron beam control structure disposed intermediate the cathode structure and the interior surface of the front panel, with the electron beam control structure supported at the edges thereof at the junction of the front panel with the back case. The areal cathode structure is of the thermionic emission type which may take the form of a plurality of parallel filaments or a grid of filaments for forming a stream of electrons which are controlled and modulated by the electron beam control structure for forming the image on the front panel. The front panel may be formed such as by pressed or molded glass, enabling a relatively thin screen.

Other objects, features and advantages of the invention will become apparent from a reading of the specification, when taken in conjunction with the drawings.

BRIEF DESCRIPTION OF THE DRAWINGS

The sole figure is a somewhat exploded cross-sectional view of a schematic depiction of the flat picture display device according to the invention.

DESCRIPTION OF THE PREFERRED EMBODIMENT

Referring now to the drawing, there is shown a shallow or flat picture display device, generally designated 10, having an enclosure formed of a metallic, generally shallow tray-shaped envelope or back case 12 suitably bonded or sealed to a trough-shaped front glass panel or display screen 14 to form an evacuated interior chamber 16.

The tray-shaped back case 12 has a generally planar or slightly dished bottom 18 with an upwardly (as viewed in the drawing) disposed sidewall 20 about the periphery thereof, which terminates with a peripheral outwardly extending lip or flange 22. The flange 22 generally defines a plane. In the bottom 18 of the tray-shaped back case 12, there are provided insulating grommets 24 within apertures therein for passage therethrough of the electric lead-in conductors 26 for providing power to an areal cathode structure 28. This cathode, for example, is designed as a thermionic cathode which is formed in any convenient manner, such as by a plurality of closely spaced generally parallel filaments, generally defining a common plane generally parallel to the plane of the peripheral flange 22. In the drawing, only one filament is shown. The tray-shaped back case 12 is formed of a metal, such as a nickel-iron alloy, having approximately the same thermal coefficient of expansion as the glass material from which the front panel (display screen) 14 is formed.

The display screen 14 is formed as a generally shallow trough-shaped glass panel, with a slightly convex exterior surface 30, and a generally planar, phosphor-coated interior surface 32. The image forming front surface of the display screen is that portion between the surfaces 30 and 32. As a consequence, the display screen 14 has a greater thickness at the center thereof than at the outer periphery thereof. By way of example, with a display screen diagonal dimension of 36 centimeter, the radius of curvature of the outer surface 32 amounts to about 3500 millimeters with screen diagonal of 36 cm. The periphery of the display screen 14 is provided with an integrally formed depending peripheral side wall 34 of shallow dimension, with the lower peripheral edge 36 of the side wall 34 defining a common plane, generally parallel to the plane of the interior surface 32. The side wall 34 extends in a direction generally perpendicular to the plane of the interior surface 32. Although not shown, it is to be understood that, in plan view, the outer edge of the display screen 14 is matingly configured, that is, it has generally the same configurations and dimensions of the outer edge of the flange 22 of the back case 12. The display screen 14 is preferably made from pressed or molded glass and can therefore be manufactured in a cost-effective and simple manner.

A panel shaped electron beam control structure 40 is interposed between the flange 22 of the back case 12 and the edge 36. Such panel shaped control structures 40 are known in the art and do not form a part of the instant invention. Such structures are formed as a microsheet sandwich construction for connection to appropriate control electronics for controlling and modulating the beam of electrons emitted by the cathode structure 28 for controlling the image displayed on the screen 14. This electron beam control structure 40 forms the stream of electrons produced by the cathode structure 28, into individual electron beams, and modulates them in accordance with the picture contents of the individual associated picture element.

For illustration purposes, in the drawing, the screen 14 and the back case 12 are depicted as spaced from one another with the electron beam control structure 40 in the intervening space. However, as constructed, the outer perimeter of the panel shaped electron beam control structure 40 is suitably bonded between the flange 22 of the back case 12 and the lower edge 36 of the side wall 34 of the screen 14, whereby the panel shaped electron beam control structure 40 is generally parallel to, and intermediate, the cathode structure 28 and the planar interior surface 32 of the screen 14.

The connection between the flange 22, the peripheral edge of the electron beam control structure 40 and the edge 36 of the side wall 34 of the display screen 12 is effected by any suitable sealing or bonding method, such as the use of glass soldering techniques, to effect a completely enclosed chamber 16, which may then be suitably evacuated by conventional evacuation methods.

Implosion protection is effected by means of a metallic band or strap 42, which encircles the outer surface of the side wall 34 of the display screen 14, with the lower edge of the band 42 (as viewed in the drawing) approximately coextensive with the plane of the lower edge 36 of the side wall 34 of the screen 14. During connection of the band 42, tension is applied to the band 42 to exert an inwardly directed force upon the side wall 34 of the display screen 14. This force of the band 42 essentially prestresses the glass of the screen 14 in a direction to counteract the force of the atmosphere on the one side and the vacuum formed on the other side. The width of the band 42 is less then the dimension of the side wall 34 from the edge 36 thereof to the plane of the interior surface 32. With the trough-shaped configuration of the display screen 14 and the tensioned encircling metal band 42, the thickness of the screen 14 between the inner and outer surfaces 32 and 30, respectively, may be relatively thin when contrasted with the prior art, while maintaining the required implosion protection and simultaneously enabling a thinner or shallower depth in an electronic image producing device. The image formation is accomplished on the interior surface 32, which is planar, and with a thinner screen and only a slight radius to the convex outer surface, distortion and attenuation of the image from the viewing side is minimized. In accordance with the instant invention, the flat image display device 10 herein described may be utilized equally for black-and-white display or the colored display of pictures or characters.

While there has been shown and described a preferred embodiment, it is to be understood that various other adaptations and modification may be made within the spririt and scope of the invention.

I claim:

1. A shallow electronic image display device having a front display screen of glass which is provided on an interior surface thereof with a layer of phosphor, a metallic tray-shaped back case with a peripheral flange, said back case serving as the rear side of said device, an areal cathode inside said back case, and a plate-shaped electron beam control structure between the cathode and the layer of phosphor, wherein:

said front display screen has a front screen surface in front of said interior surface and a peripheral side wall extending from said front screen surface to a rear edge surface located rearwardly of said interior surface, with said edge in abutting relation with said flange of said back case and implosion protection means is provided to exert an inwardly directed force upon said peripheral side wall.

2. An image display device according to claim 1 wherein said implosion protection means includes a tensioned metallic band.

3. An image display device according to cvlaim 1, wherein said interior surface of said display screen is planar, and said front surface of said display screen is slightly curved outwardly.

4. An image diaplay device according to claim 2, wherein said interior surface of said display screen is planar, and said front surface of said display screen is slightly curved outwardly.

5. An image display device according to claim 3 wherin the radius of curvature of said front surface of the display screen is about 3500 millimeters.

6. An image display device according to claim 3 wherein said display screen is formed of pressed glass.

7. An image display device according to claim 3 wherein said display screen is formed of molded glass.

8. An image display device according to claim 1 wherein said implosion protection means is a metallic band having a width less than the dimension of said side wall, said metal bonding tensioned and encircling said side wall with an edge thereof in proximate relation to the edge of said side wall.

9. A shallow electronic image display device having
a front display screen of glass which is provided on an interior surface thereof with a layer of phosphor;
a metallic tray-shaped back case with a peripheral flange and forming
an areal cathode inside said back case, and
a plate-shaped electron beam control structure between the cathode and the layer of phosphor,
wherein:
said front display screen has a front screen surface in front of said interior surface and an integrally formed peripheral side wall extending from said front screen surface to a rear edge surface located rearwardly of said interior surface, with said edge surface defining a plane and
wherein said image display device further comprises:
means for sealably coupling said rear edge surface of said front display screen in abutting relation with said flange of said back case; and
implosion protection means including a tensioned metallic band encircling the outer periphery of said side wal in proximate relation to the junction of said edge.

10. An image display device according to claim 9 wherein said display screen has a convex exterior surface and a planar interior surface, and said side wall extends generally perpendicular to said planar interior surface.

11. An image display device according to claim 10 wherein the radius of curvature of said outer surface of the display screen is about 3500 millimeters.

12. A shallow electronic image display device comprising:
a metallic tray-shaped back case having a bottom, peripheral side walls and a peripheral flange on said side walls defining a plane;
an areal cathode structure mounted within said back case;
a plate-shaped electron beam control structure mounted in front of said cathode structure;
a display screen with an interior screen surface and a peripheral side wall with the edge thereof extending rearwardly from said interior surface;
means for bonding said edge in abutting relation with said flange of said back case; and
implosion protection means for exerting an inwardly directed force upon said peripheral side wall of said display screen.

13. The combination according to claim 12 wherein said implosion protection means includes a tensioned metallic band.

14. The combination according to claim 13 wherein said interior surface of said display screen is planar and coated with a layer of phosphor, and the outer surface of said display screen is slightly curved outwardly.

15. The combination according to claim 14 wherein the radius of curvature of said outer surface of the display screen is about 3500 millimeters.

16. The combination according to claim 15 wherein said display screen is formed of pressed glass.

17. The combination according to claim 15 wherein said display screen is formed of molded glass.

* * * * *

UNITED STATES PATENT AND TRADEMARK OFFICE

CERTIFICATE OF CORRECTION

PATENT NO. : 4,720,657

DATED : January 19, 1988

INVENTOR(S) : Tischer

It is certified that error appears in the above-identified patent and that said Letters Patent is hereby corrected as shown below:

Column 4 Line 48 — Change "cvclaim" to -- claim --

Column 4 Line 52 — Change "diaplay" to -- display --

Column 4 Line 66 — Change "bonding" to -- band being --

Column 5 Line 23 — Change "wal" to -- wall --

Signed and Sealed this

Second Day of August, 1988

*Attest:*

*Attesting Officer*

DONALD J. QUIGG

*Commissioner of Patents and Trademarks*